US006908165B2

(12) United States Patent
Pinard

(10) Patent No.: US 6,908,165 B2
(45) Date of Patent: Jun. 21, 2005

(54) PRINTING FLUID DELIVERY SYSTEM

(75) Inventor: Adam I. Pinard, Carlisle, MA (US)

(73) Assignee: Creo Americas, Inc., Billerica, MA (US)

( * ) Notice: Subject to any disclaimer, the term of this patent is extended or adjusted under 35 U.S.C. 154(b) by 0 days.

(21) Appl. No.: 10/271,704

(22) Filed: Oct. 15, 2002

(65) Prior Publication Data

US 2004/0070636 A1 Apr. 15, 2004

(51) Int. Cl.[7] ..... B41J 2/195
(52) U.S. Cl. ..... 347/7; 347/84; 347/85
(58) Field of Search ..... 347/7, 6, 85, 89, 347/76, 84

(56) References Cited

U.S. PATENT DOCUMENTS

| | | | | |
|---|---|---|---|---|
| 4,063,252 A | * | 12/1977 | Jensen et al. | 347/6 |
| 4,998,116 A | * | 3/1991 | Regnault | 347/6 |
| 5,160,938 A | | 11/1992 | Fargo et al. | 347/19 |
| 5,418,557 A | * | 5/1995 | Pullen | 347/7 |
| 5,420,624 A | * | 5/1995 | Braun et al. | 347/76 |

* cited by examiner

*Primary Examiner*—Hai Pham
*Assistant Examiner*—Lam Nguyen
(74) *Attorney, Agent, or Firm*—Kristofer E. Elbing

(57) ABSTRACT

A printing fluid delivery method is disclosed for a jet printer. The method involves displacing printing fluid in a printing fluid delivery chamber in a printing fluid delivery system by a predetermined amount. After the step of displacing, printing fluid can be driven out of the chamber at a constant flow rate.

11 Claims, 6 Drawing Sheets

10

PRINTING FLUID DELIVERY SYSTEM

FIELD OF THE INVENTION

This application relates to printing fluid delivery systems, such as ink delivery systems for delivering ink in inkjet printers.

BACKGROUND OF THE INVENTION

Prior art inkjet printers have regulated ink pressure using feedback control to achieve uniform ink delivery. As shown in FIG. 1, an ink delivery system of this type 10 can use a motor 12 to drive a lead screw 14 that has teeth coupled to a piston 16 that is mounted to slide within a cylinder 18. One or more seals 20 located between the piston and cylinder help to form a tightly sealed, variable-volume chamber 22. The cylinder is also equipped with a pressure transducer 24 that measures the pressure within the chamber, with a supply orifice 26 that receives ink from a reservoir 28 via a check valve 30, and with a delivery orifice that delivers the ink to pen 32 equipped with a nozzle 34. A controller 38 has an input connected to the pressure transducer and an output connected to an input of the motor 12.

The prior art ink delivery system 10 shown begins its operation with the motor 12 causing the lead screw 14 to rotate in its reverse direction. This pulls the piston 16 back out of the cylinder 18 and thereby draws ink from the reservoir 28 through the check valve 30 into the chamber 22. Once the chamber is full, the motor rotates the lead screw in its forward direction. This causes an increase in pressure that shuts the check valve and forces ink to flow out of the nozzle 34. The ink stream is then broken into droplets, which can be deposited onto a print substrate 36 according to well known inkjet printing techniques.

During ink deposition, a feedback control loop keeps pressure in the chamber 22 uniform by causing the controller 34 to modulate its output signal as a function of the pressure signal it receives from the pressure transducer 32. This type of control has been capable of delivering uniform streams of ink for a particular nozzle. But nozzles are often changed in the course of printing operations, and it has been found that normal tolerance variations in nozzle diameter can cause significant differences in drop size, which in turn result in visibly different print output. To address this problem, a dual-mode regulation method was developed.

The dual-mode regulation method uses flow regulation to calibrate the system. When it has settled into a steady state, the controller records the pressure. This recorded pressure is then used as a target pressure in subsequent printing cycles. Steady state is achieved once the parts in the system have had time to settle into their expanded dimensions in the presence of the increased operating pressure and temperature. During the subsequent flow regulation phase, the controller causes the motor to move at a fixed speed, such as by issuing stepper motor step signals at a fixed rate.

SUMMARY OF THE INVENTION

In one general aspect, the invention features a printing fluid delivery method for a jet printer. This method includes displacing printing fluid in a printing fluid delivery chamber in a printing fluid delivery system by a predetermined amount, and driving printing fluid out of the chamber at a constant flow rate after the step of displacing.

In preferred embodiments, the method can further include the step of retrieving the predetermined amount from storage for use in the step of displacing. The method can further include the step of measuring a flow characteristic of the printing fluid after at least part of the step of displacing. The method can further include the step of adjusting the predetermined amount by an incremental adjustment based on the step of measuring and again displacing an amount of printing fluid corresponding to the predetermined adjustment. The step of adjusting can be part of a step-wise control process, which includes a plurality of measurement and adjustment steps. The step of adjusting can be part of a multiplexed control process. The method can further include the step of awaiting stabilization of the printing fluid delivery system after the step of displacing. The method can further include the step of measuring a flow characteristic of the printing fluid after the step of awaiting stabilization. The step of awaiting stabilization can include a step of measuring a flow characteristic of the printing fluid. The step of awaiting stabilization can operate by determining when variations in a value of the flow characteristic fall below a predetermined amount. The step of awaiting stabilization can operate by measuring a charge of the printing fluid. The method can be performed independently of any pressure measurement. The step of compressing can be performed by moving an actuator at a first rate, with the step of driving being performed by moving the actuator at a second rate that is lower than the first rate. The method can further include the step of depositing at least some of the printing fluid on a substrate after at least part of the step of displacing.

In another general aspect, the invention features a printing fluid delivery system for a jet printer that includes a printing fluid delivery chamber, an actuation system operative to displace printing fluid in the chamber, and a controller including logic operative to cause the actuation system to move by a predetermined amount at a first rate and to then drive the actuation system at a second, predetermined rate that is lower than the first rate.

In preferred embodiments, the system can further include storage for the predetermined amount, with the controller being responsive to the storage. The printing fluid delivery chamber can be defined by a piston and a cylinder, with the actuation system being operative to drive the piston. The actuation system can include a motor. The controller can further include logic operative to adjust the predetermined amount and store the adjusted predetermined amount. The controller can be multiplexed to serve a plurality of printing fluid delivery chambers. The apparatus can be operative independently of any pressure sensor. The system can further include a flow characteristic sensor, which can include a charge sensor.

In a further general aspect, the invention features a printing fluid delivery system for a jet printer that includes means for displacing printing fluid in a printing fluid delivery chamber in a printing fluid delivery system by a predetermined amount, and means for driving printing fluid out of the chamber at a constant flow rate after displacement by the means for displacing.

In another general aspect, the invention features a printing fluid delivery method for a jet printer that includes monitoring a printing fluid flow rate of printing fluid at a nozzle, and adjusting a displacement rate of the printing fluid based on the step of monitoring.

In preferred embodiments, the method can further include the steps of awaiting stabilization of the printing fluid delivery system, and displacing at least some of the printing fluid out of the chamber at a constant displacement rate. The step of adjusting can be part of a continuous control process.

The step of monitoring can include a step of measuring the charge of drops in the fluid flow. The method can be performed independently of any pressure measurement. The method can further include the step of depositing at least some of the printing fluid on a substrate after at least part of the step of adjusting.

In a further general aspect, the invention features a printing fluid delivery system for a jet printer that includes a printing fluid delivery nozzle, a flow measurement sensor responsive to printing fluid flow at the printing fluid delivery nozzle, a printing fluid supply actuator operative to adjust printing fluid flow at the printing fluid delivery nozzle, and a controller responsive to the flow measurement sensor and having a control output provided to the actuator.

In preferred embodiments, the controller can include continuous control circuitry. The flow measurement sensor can be a charge sensor. The apparatus can be operative independently of any pressure sensor.

In another general aspect, the invention features a printing fluid delivery method for a jet printer that includes means for monitoring a printing fluid flow rate of printing fluid at a nozzle, and means, responsive to the means for monitoring, for adjusting a displacement rate of the printing fluid.

Printing fluid delivery systems according to the invention can allow for precise metering of printing fluid in a jet printer. And this precise metering can be made available without the need for a pressure transducer and associated wiring and control logic. As a result, printers that employ delivery systems according to the invention can be less complex and therefore more reliable and less expensive to build and maintain. These benefits can be particularly important in printers that employ multiple nozzles, such as color printers or interleaved printers. For example, a four-color printer with two spot colors and two-to-one interleaving would require twelve pressure transducers. These pressure transducers and associated wiring and control logic can significantly increase the cost and complexity of the printer.

Systems according to the invention may even deposit ink more precisely than prior art pressure-regulated systems because they are insensitive to temperature changes. Specifically, variations in temperature could result in printing artifacts in prior art pressure-regulated systems because the pressure required for uniform delivery is temperature-dependant. But systems according to the invention need not monitor pressure at all, and they can therefore be made to be relatively insensitive to temperature. The resulting increased precision can be extremely important in high-end printing, because color accuracy and consistency in these systems have been found to be highly dependent on drop size.

DETAILED DESCRIPTION OF AN ILLUSTRATIVE EMBODIMENT

Figure 1:
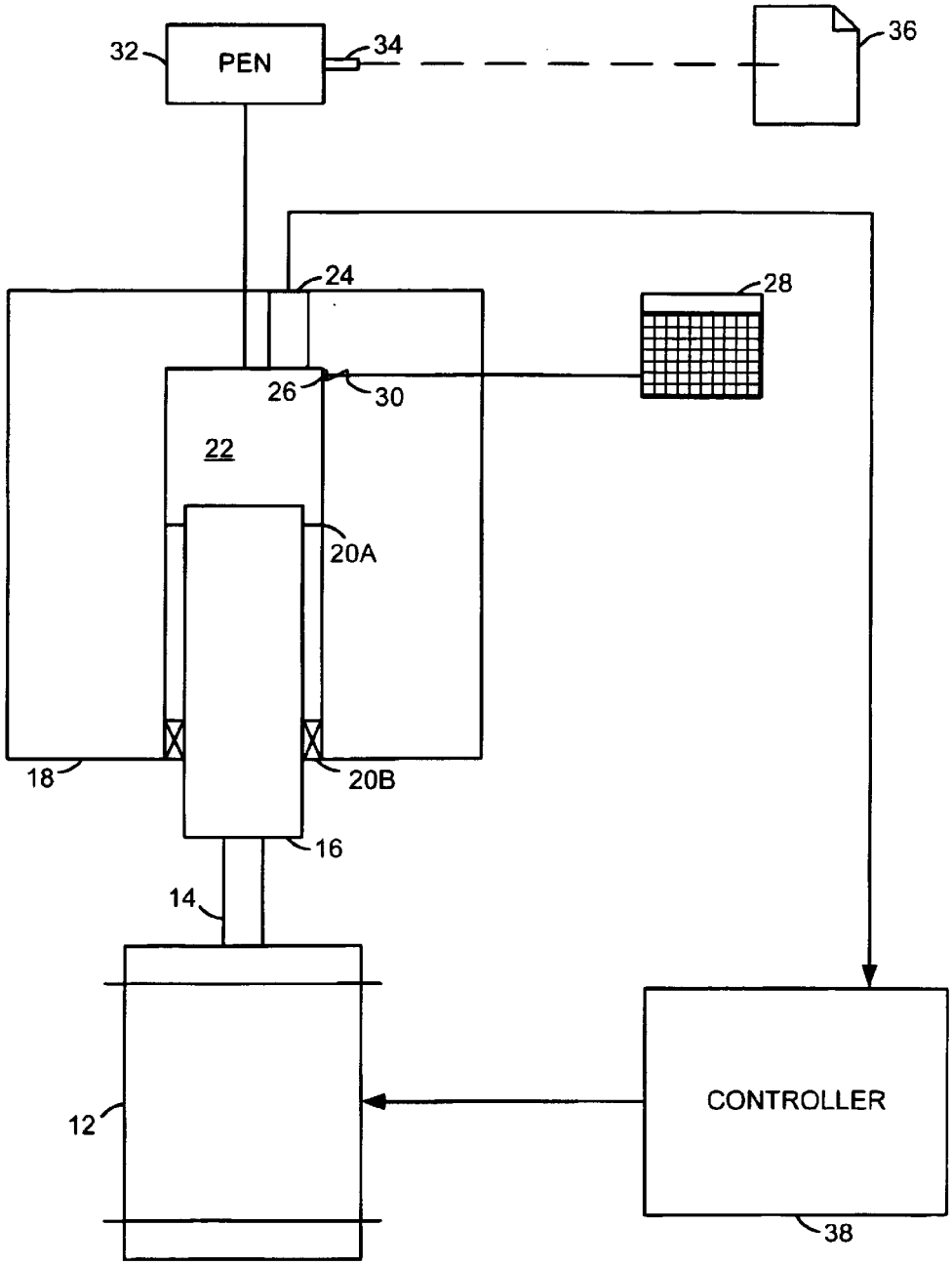
PRIOR ART FIG. 1
FIG. 1 is a block diagram illustrating a prior art inkjet ink delivery system.

An illustrative printing fluid delivery system will now be discussed in connection with FIG. 2. While this system is described as delivering ink, it is also suitable for use in other types of printing systems, such as direct-to-plate systems, which can dispense plate-writing fluid instead of ink. These plate-writing fluids include direct plate-writing fluids, which by themselves change properties of plates to allow them to be used in printing presses, and indirect plate-writing fluids, which require further process steps.

The illustrative ink delivery system 40 can include a motor 12 having an output shaft operatively connected to a lead screw 14. The lead screw has teeth coupled to a piston 16 that is mounted to slide within a cylinder 18. And while the motor and lead screw are used in this embodiment to drive the piston, other types of actuators, such as pneumatic or hydraulic actuators, could also be used.

A seal (20A or 20B) located between the piston 16 and cylinder 18 help to form a tightly sealed, variable-volume chamber 22. The cylinder is also equipped with a supply orifice 26 that receives ink from a reservoir 28 via a check valve 30, and a delivery orifice that delivers a printing fluid to a pen 32 that includes a nozzle 34. The nozzle can be moved in front of a print substrate 36 or a flow sensor 42, such as a charge sensor. A controller 44 has an input operatively connected to an output of the motor, and an output operatively connected to an input of the motor 12, but this embodiment does not require a pressure transducer, and its controller does not need an input for receiving a pressure transducer signal.

Figure 2:
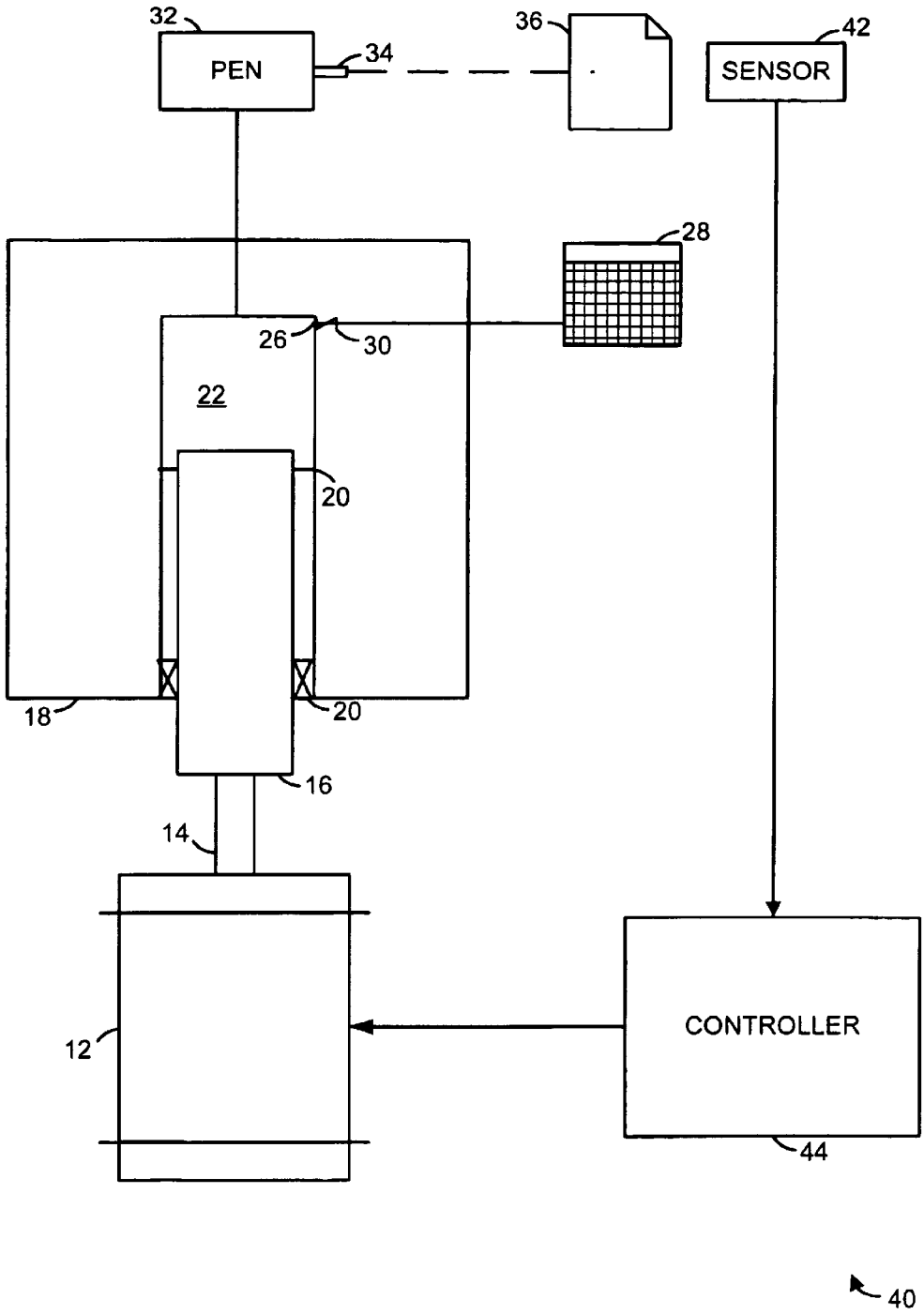
FIG. 2 is a block diagram of an ink delivery system according to the invention.
Figure 3:
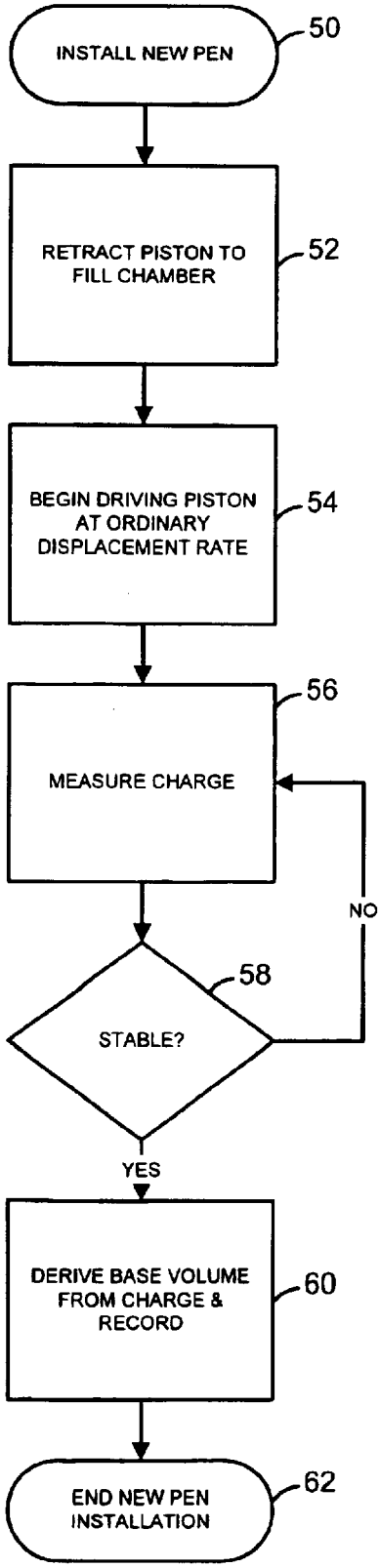
FIG. 3 is a flowchart illustrating new nozzle maintenance operations for the ink delivery system of FIG. 2.
Figure 4:
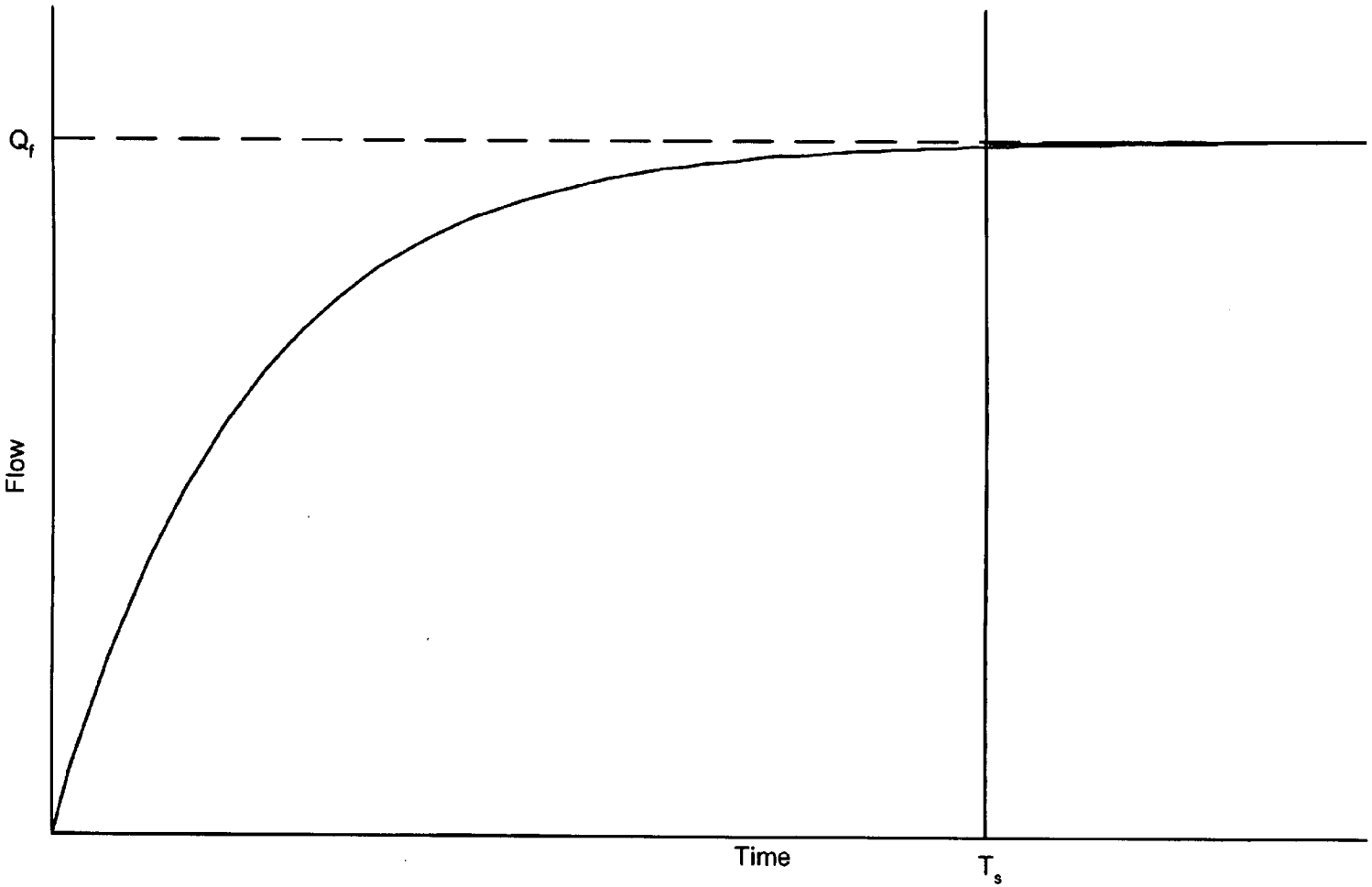
FIG. 4 is an illustrative graph of ink flow versus time for the system of FIG. 2 during the new nozzle maintenance operations presented in FIG. 3.

Referring to FIGS. 2–4, the ink delivery system starts a set of maintenance operations when a nozzle is first installed in the ink delivery system (step 50). These operations are performed with the nozzle in front of the charge sensor 42, which allows the system to measure the flow rate of the drops emitted by the nozzle by measuring the charge on the drops. This measurement relies on the fact that the charge for a given change in voltage is proportional to drop velocity, which is in turn proportional to flow rate. A suitable charge sensor can be based on the target block described in U.S. Pat. No. 5,160,938, which is herein incorporated by reference.

Flow rate is measured in this embodiment by stepping the charge tunnel voltage on the nozzle between two values (e.g., +/−20 volts) for the current nozzle only, and then comparing the resulting probe signal for the two values. But other methods of obtaining the flow rate, velocity, or other related information could also be used. Examples of such approaches could include using an optical sensor, or measuring the current supplied to charge the drops.

The maintenance operations begin with the system causing the motor 12 to retract the piston 16 to fill the chamber 22 (step 52). The motor then begins to drive the piston back into the cylinder at the system's ordinary ink delivery rate (step 54). As the piston moves, the drop charge is continuously monitored by the probe (step 56) and tested to determine if it has stabilized by detecting the time at which variations in the charge fall below a predetermined threshold (step 58).

During this part of the process, the flow in the chamber increases generally according to the following relationship (see FIG. 4):

$$Q=Q_f(1-e^{-kt}) \quad (1)$$

Where Q is flow rate, $Q_f$ is the final steady state flow rate, and k is a constant that can be determined empirically for the system. The system will detect stabilization at a point in time $T_s$ at which the pressure has generally stabilized and all of the parts of the system are substantially fully expanded.

The stabilized nozzle flow rate value can then be converted into a base volume value that will be used in later operations. It has been found that there is a predictable relationship between the nozzle flow rate value and the corresponding base volume value. The base volume value can therefore be determined from nozzle and pump characteristics for a particular system. The base calculated value for the nozzle is then stored (step 60) and the maintenance operations that relate to fluid delivery are completed (step 62).

Figure 5:
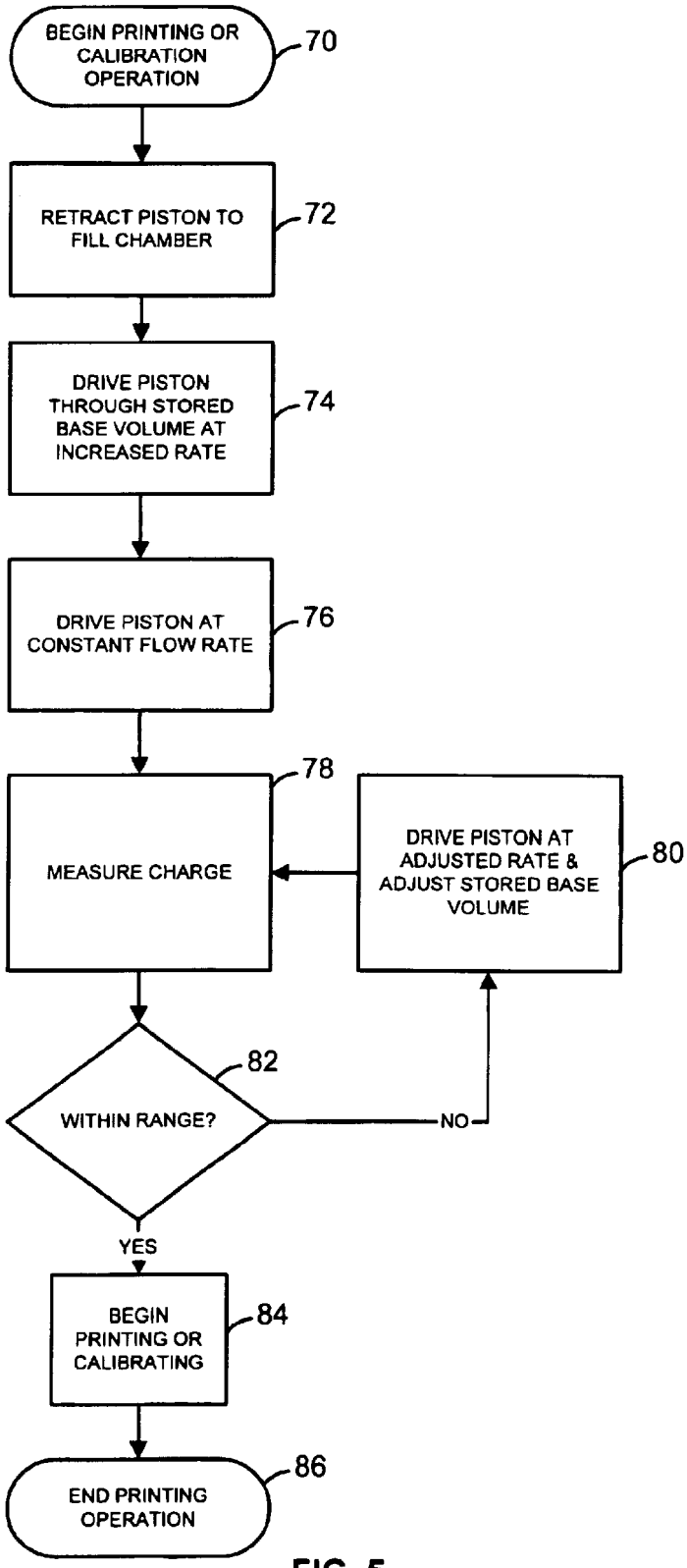
FIG. 5 is a flowchart illustrating ink delivery operations made in at the beginning of printing operations for the ink delivery system of FIG. 2.
Figure 6:
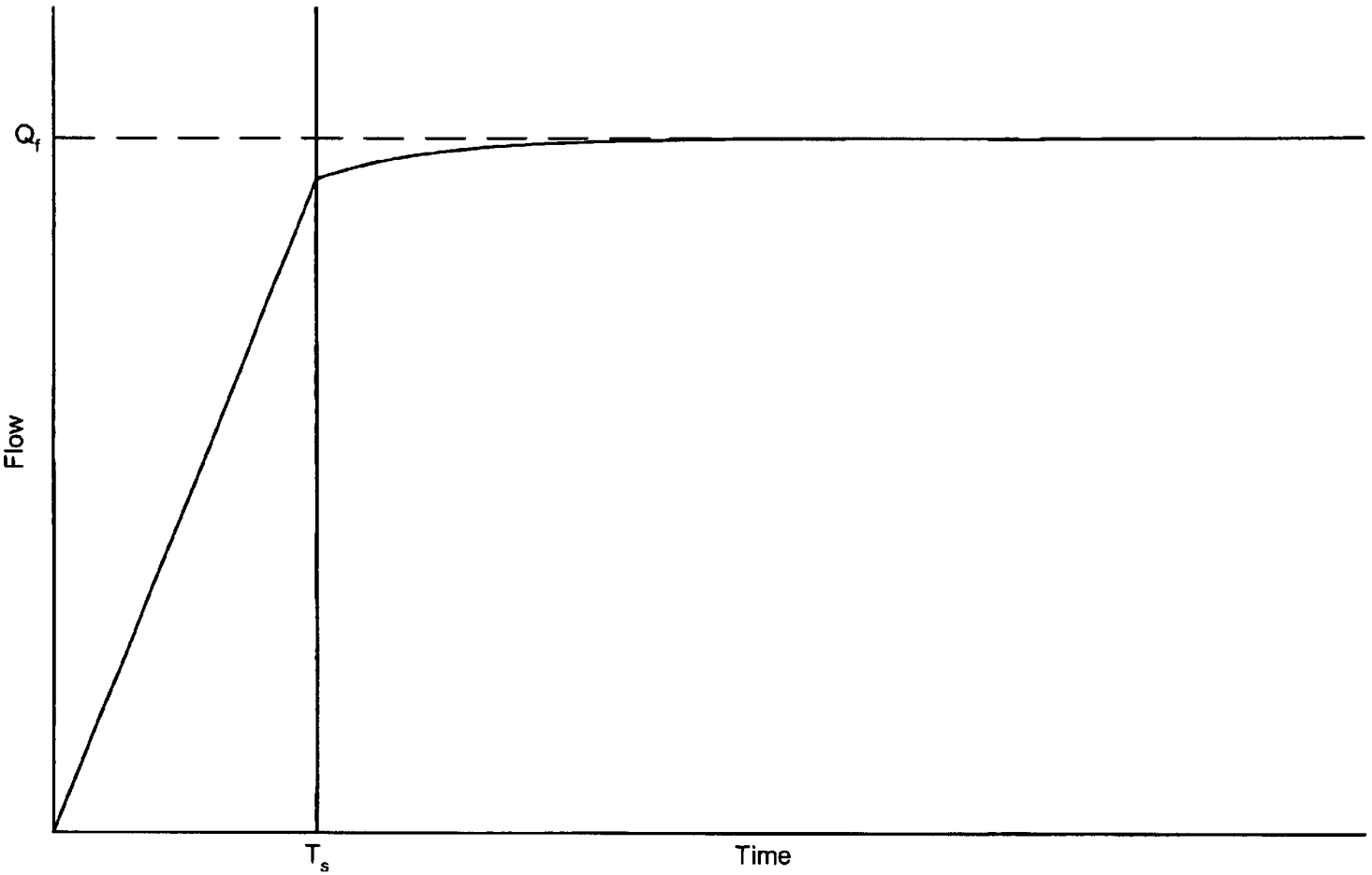
FIG. 6 is an illustrative graph of ink flow versus time for during the ink delivery operations presented in FIG. 5.

Referring to FIGS. 2 and 5–6, when calibration or printing operations begin (step 70), the system first causes the motor 12 to retract the piston 16 to fill the chamber 22 (step 72). The controller then causes the motor to begin to drive the piston back into the cylinder through the stored base distance at an increased rate (step 74). This results in an accelerated expansion of the system, and thereby causes its ink delivery to stabilize more quickly than it would at the ordinary constant rate. And this benefit can be achieved without use of a pressure transducer.

After the motor 12 has moved the piston 16 through its base distance, it begins to move the piston at a constant flow rate (step 76). As the piston moves, the system measures the drop charge for the chamber (step 78). If this charge value is sufficiently close to the value measured during the maintenance operations (step 82), fluid delivery can proceed at the constant flow rate (step 84) until the end of the calibration or printing operation (step 86). If the charge is too high or too low, the controller can drive the piston forward or backward by an incremental distance in an effort to achieve a charge that is sufficiently close to the stabilized value measured during the maintenance operations (step 80). This process can be repeated on a stepwise or continuous basis until stabilization has occurred and printing can begin. The value of any added incremental distances can then be used to update the stored base value for the next printing or calibration operation. As a result, the system should converge toward a base value that causes the system to quickly reach a stable operating point.

During the initial high-speed injection, the pressure in the chamber can increase generally linearly in one or more steps. Once the system has reached a flow that is sufficiently close to the target flow (i.e. at time $T_s$), the motor speed is reduced to the ordinary rate, and any remaining pressure changes take place according to the relationship described above (1).

In one embodiment, the chamber has a 10 cc capacity, and the nozzle is 9 $\mu$m+/−0.2 $\mu$m in diameter. The ordinary ink delivery rate is 3.3 $\mu$l/s, and the increased rate is 150 $\mu$l/s. The observed time constant is around two minutes, so that the initial full settling measurement takes around 10 minutes, with a typical initial injection value of around 220 $\mu$l.

In this embodiment, the control circuitry is digital and shared between eight nozzles, with measurements and adjustments for each of the nozzles being performed sequentially. Adjustments are therefore made only during the first time slot available after correction is complete. Of course, control circuitry could be duplicated for all of the printing channels to allow for continuous control, but this would result in additional expense.

One optimization to the system involves advancing the piston at an increased rate during some or all of the maintenance operations (i.e., before step 54 in FIG. 3). This optimization allows the maintenance operations to take place more quickly. It can use a conservative nominal base piston distance that works well for even worst-case tolerance variations.

The present invention has now been described in connection with a number of specific embodiments thereof. However, numerous modifications which are contemplated as falling within the scope of the present invention should now be apparent to those skilled in the art. For example, while the fluid delivery system described above is based on a piston-and-cylinder-based pump, suitable systems could also be built around other types of architectures. It is therefore intended that the scope of the present invention be limited only by the scope of the claims appended hereto. In addition, the order of presentation of the claims should not be construed to limit the scope of any particular term in the claims.

What is claimed is:

1. A printing fluid delivery method for a jet printer, comprising:

displacing printing fluid in a printing fluid delivery chamber in a printing fluid delivery system by a predetermined amount, driving printing fluid out of the chamber at a constant flow rate after the step of displacing, and awaiting stabilization of the printing fluid delivery system after the step of displacing, wherein the step of awaiting stabilization includes a step of measuring a flow characteristic of the printing fluid, and wherein the step of awaiting stabilization operates by determining when variations in a value of the flow characteristic fall below a predetermined amount.

2. A printing fluid delivery method for a jet printer, comprising:

displacing printing fluid in a printing fluid delivery chamber in a printing fluid delivery system by a predetermined amount at a first rate, and driving printing fluid out of the chamber at a second, constant flow rate after the step of displacing, wherein the second rate is lower that the first rate, and wherein the step of displacing is performed by moving an actuator at a first movement rate and wherein the step of driving is performed by moving the actuator at a second movement rate that is lower than the first movement rate.

3. A printing fluid delivery system for a jet printer, comprising:

a printing fluid delivery chamber, an actuation system operative to displace printing fluid in the chamber, and a controller including logic operative to cause the actuation system to move by a predetermined amount at a first rate and to then drive the actuation system at a second, predetermined rate that is lower than the first rate.

4. The apparatus of claim 3 further including storage for the predetermined amount, and wherein the controller is responsive to the storage.

5. The apparatus of claim 3 wherein the printing fluid delivery chamber is defined by a piston and a cylinder, and wherein the actuation system is operative to drive the piston.

6. The apparatus of claim 5 wherein the actuation system includes a motor.

7. The apparatus of claim 3 wherein the controller further includes logic operative to adjust the predetermined amount and store the adjusted predetermined amount.

8. The apparatus of claim 3 wherein the controller is multiplexed to serve a plurality of printing fluid delivery chambers.

9. The apparatus of claim 3 wherein the apparatus is operative independently of any pressure sensor.

10. The apparatus of claim 3 further including a flow characteristic sensor.

11. The apparatus of claim 10 wherein the flow characteristic sensor includes a charge sensor.

* * * * *